United States Patent [19]

Pèbre

[11] Patent Number: 4,667,991

[45] Date of Patent: May 26, 1987

[54] MECHANISM FOR ASSISTING THE CLOSING OF A DOOR OF A MOTOR VEHICLE.

[75] Inventor: Thierry Pèbre, Paris, France

[73] Assignee: Compagnie Industrielle de Mecanisme en abrege C.I.M., France

[21] Appl. No.: 824,916

[22] Filed: Feb. 3, 1986

[30] Foreign Application Priority Data

Feb. 7, 1985 [FR] France ..... 8501713

[51] Int. Cl.[4] ..... E05C 3/26

[52] U.S. Cl. ..... 292/201; 292/216; 292/DIG. 23

[58] Field of Search ..... 292/201, 216, 280, DIG. 23, 292/341.16

[56] References Cited

U.S. PATENT DOCUMENTS

| | | | |
|---|---|---|---|
| 4,395,064 | 7/1983 | Bellot et al. | 292/201 |
| 4,468,941 | 9/1984 | Bascou | 292/201 X |
| 4,518,180 | 5/1985 | Kleefeldt et al. | 292/201 |
| 4,593,945 | 6/1986 | Arute et al. | 292/201 |
| 4,597,598 | 7/1986 | Bascou | 292/201 X |

*Primary Examiner*—Robert L. Wolfe
*Assistant Examiner*—Lloyd A. Gall

[57] ABSTRACT

The mechanism comprises:

a lever (8) pivotally mounted on a fixed pin (9) at one of the ends of the lever, a fork member (11) rotatively mounted on a pin (12) fixed to the lever (8), the fork member being adapted to receive a keeper (3) fixed to a center post of the body of the vehicle, this fork member (11) being provided with an elastically yieldable element (13) for returning it to its position in which it is disengaged from the keeper (3), a device (14) for locking the fork member (11) to the keeper (3) during the pivoting of the lever (8), the locking being effected before the pivoting of the lever, and a cam (17) rotatable about a fixed pin (18) and capable of being driven in rotation by a motor (10) which is automatically started up by the locking of the fork member (11) at the beginning of the closing travel of the door (1).

8 Claims, 9 Drawing Figures

MECHANISM FOR ASSISTING THE CLOSING OF A DOOR OF A MOTOR VEHICLE

BACKGROUND OF THE INVENTION

The present invention relates to a mechanism for assisting the closing of a door of a motor vehicle, adapted to be disposed in this door.

Indeed, a need has been felt for some time on the part of some motor vehicle drivers to see vehicle doors equipped with mechanisms for assisting the closing of the latter in the final stage of the closing. Such a mechanism has the advantage of enabling the user to avoid having to slam the door in order to close it properly.

An object of the invention is therefore to provide such a mechanism which has a structure which is not excessively complicated, is of relatively moderate cost price and which moreover affords the necessary safety in the event of a foreign body being introduced between the door and the chassis which prevents the complete closure of the door.

SUMMARY OF THE INVENTION

According to the invention, the mechanism for assisting the closing of a door comprises:

a lever mounted to be pivotable about a fixed pin at one of its ends, a fork member mounted to be rotatable about a pin fixed to the opposite end of the lever and adapted to be capable of receiving a keeper fixed to a center post which is part of the body of the vehicle, said fork member being provided with an elastically yieldable element which biases it to its position in which it is disengaged from the keeper, means for locking the fork member on the keeper during the pivoting of the lever, the locking occurring before the pivoting of the lever, and a cam mounted to be rotatable about a fixed pin parallel to the pivot pins of the lever and the fork member, and capable of being driven in rotation by a motor which is automatically started up by said locking of the fork member at the start of the closing travel of the door, said cam having such contour as to be capable of cooperating with the lever so as to pivot the lever in opposition to the opposing action of an elastically yieldable return element which biases the lever against the cam.

Thus, it will be understood that this mechanism is brought into action at the moment when the fork member, which includes a suitable hook, comes to engage against the fixed keeper of the center post, which brings about the locking of this fork member and consequently the starting up of the motor for driving the cam whose rotation pivots the lever. As the latter is engaged with the fixed keeper through the fork member, it therefore drives the door in rotation which terminates its closing movement until it has swung through a predetermined angle corresponding to the complete closure of the door with an excess travel so as to ensure a good locking of the latch.

According to a feature of the invention, the means for locking the fork member on the keeper is a pawl pivotally mounted on a pin parallel to the pivot pin of the fork member and positioned close to the pivot pin, and this pawl is provided with a spring which biases it in either of two stable positions, in one of which the fork member is unlocked relative to the pawl.

The first of these stable positions is occupied by the pawl when the door is opened while the second position is assumed by the pawl at the end of the door-closing movement.

When it is desired to open the door, the keeper remains engaged in the fork member while the latter and its support lever pivot until it again comes into contact with the cam. At this moment, the fork member pivots under the action of its elastically yieldable return element and releases the keeper so that the door may be opened normally.

Further features and advantages of the invention will be apparent from the following description with reference to the accompanying drawings which illustrate an embodiment of the invention by way of a non-limiting example.

DESCRIPTION OF THE PREFERRED EMBODIMENT

Figure 9:
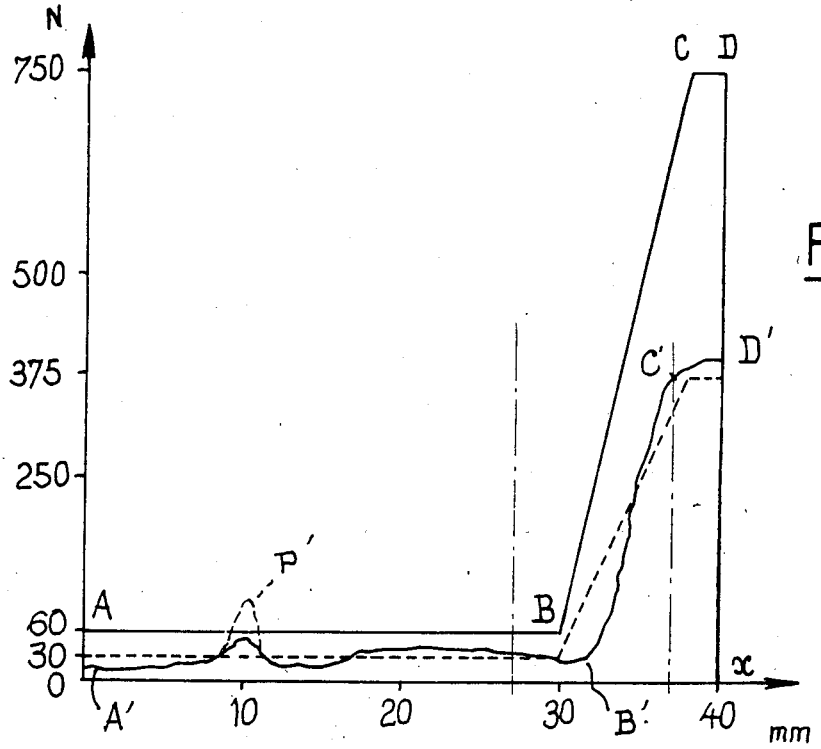
FIG. 9 is a diagram illustrating the forces developed by the mechanism during a closing cycle of the door, the forces being plotted as ordinates and the length of the travel abscissae.

The objects of the invention achieved by the use of the assisting mechanism which will be described hereinafter are the following:

(a) assist the closing of opening elements of vehicles (through 40 mm) by an electromechanical system which is as small and as simple as possible and is mounted in addition to a conventional latch with no connection with the latter;

(b) avoidance of a hindrance of the operation of the door in the event of a conventional use (slamming of the door) or a break-down of the mechanism;

(c) ensure the necessary safety itself in a mechanical manner; the latter point may be explained as follows:

great force is required for compressing the door sealing element;

in order to ensure that the mechanism be without danger, it must be ensured that a foreign body located in the door rabbet or introduced in the course of the closure of the door is not subjected to an excessive force;

now, the great force is only required in the last millimeters of the travel when it is no longer possible that there remain or that there be introduced a foreign body in the rabbet;

this is the reason for the required force-travel diagram shown in FIG. 9.

Figure 1:
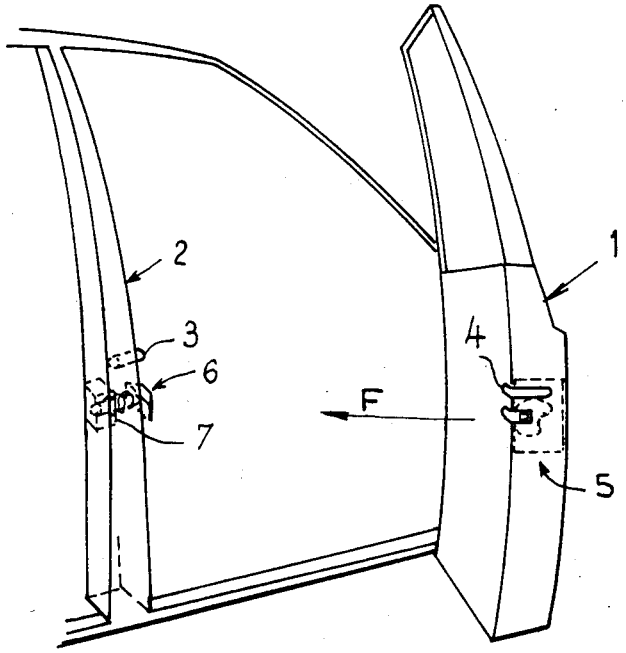
FIG. 1 is a diagrammatic perspective view of a motor vehicle door which may be equipped with a door-closing assisting mechanism according to the invention, and of the corresponding part of the body of the vehicle, this door being in its open position.

FIG. 1 shows a front door 1 of a motor vehicle in its open position and a center post 2 of the body of the vehicle corresponding to this door. The post 2 is equipped with a fixed keeper 3 which projects forwardly of the vehicle so as to be capable of being introduced in a corresponding slot 4 provided in the upper part of an assisting mechanism 5 for the closure of the door 1 disposed in the edge of the latter facing the keeper 3 when the door 1 is closed.

The center post 2 contains, below the keeper 3, a stop 6 which is resiliently biased by a spring 7 to a position in which its head projects forwardly relative to the post 2, this head being suitably rounded so as to define a curved surface which permits, by a lateral thrust exerted on this projecting head, retracting the latter within the post 2 against the returning action of the spring 7. The function of the retractable stop 6 will be explained hereinafter.

Figure 2:
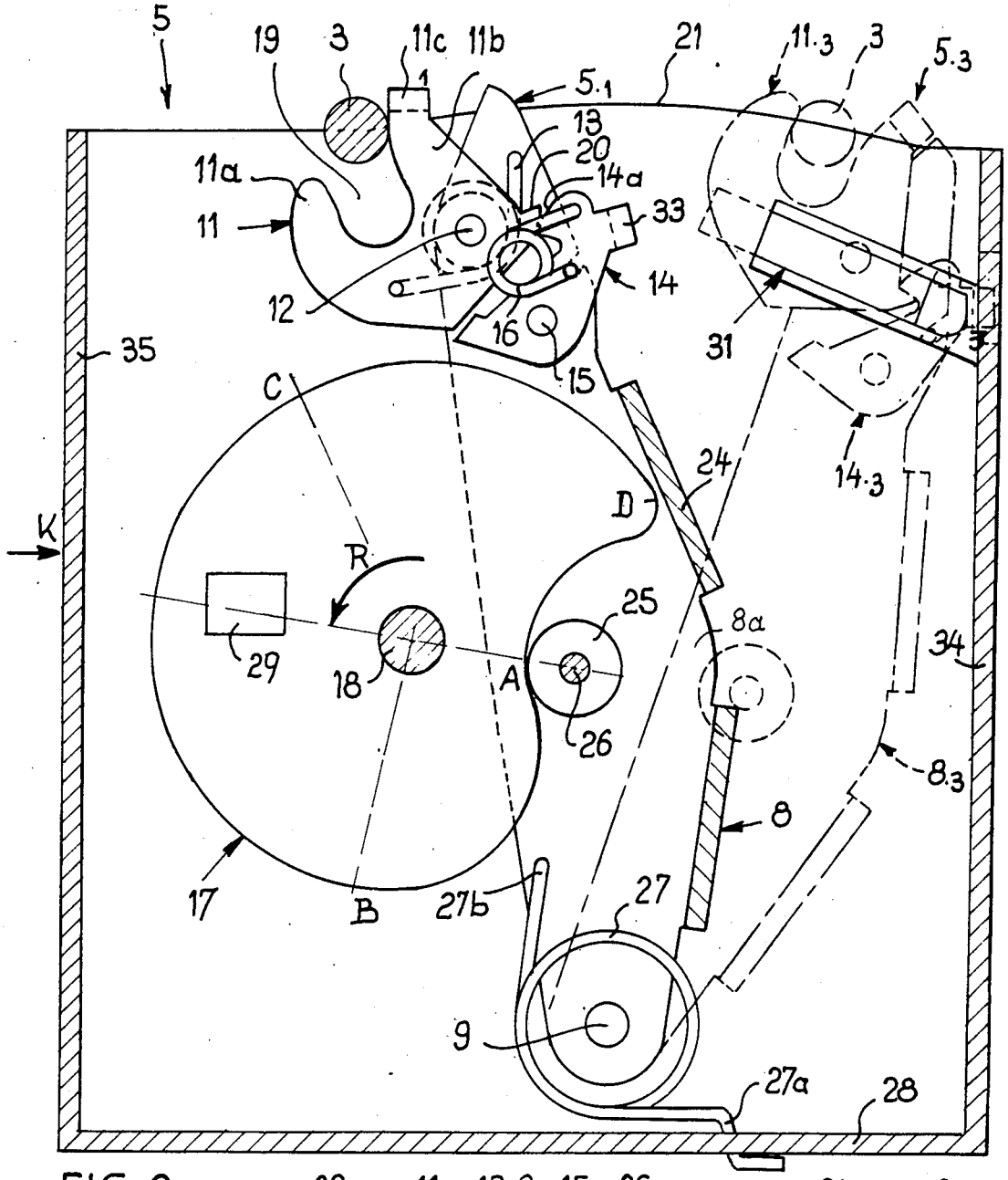
FIG. 2 is a half-sectional, half-elevational view in a median vertical plane of an embodiment of the assisting mechanism according to the invention, two possible different positions of this mechanism being shown, one in full lines and the other in dotted lines.
Figure 4:
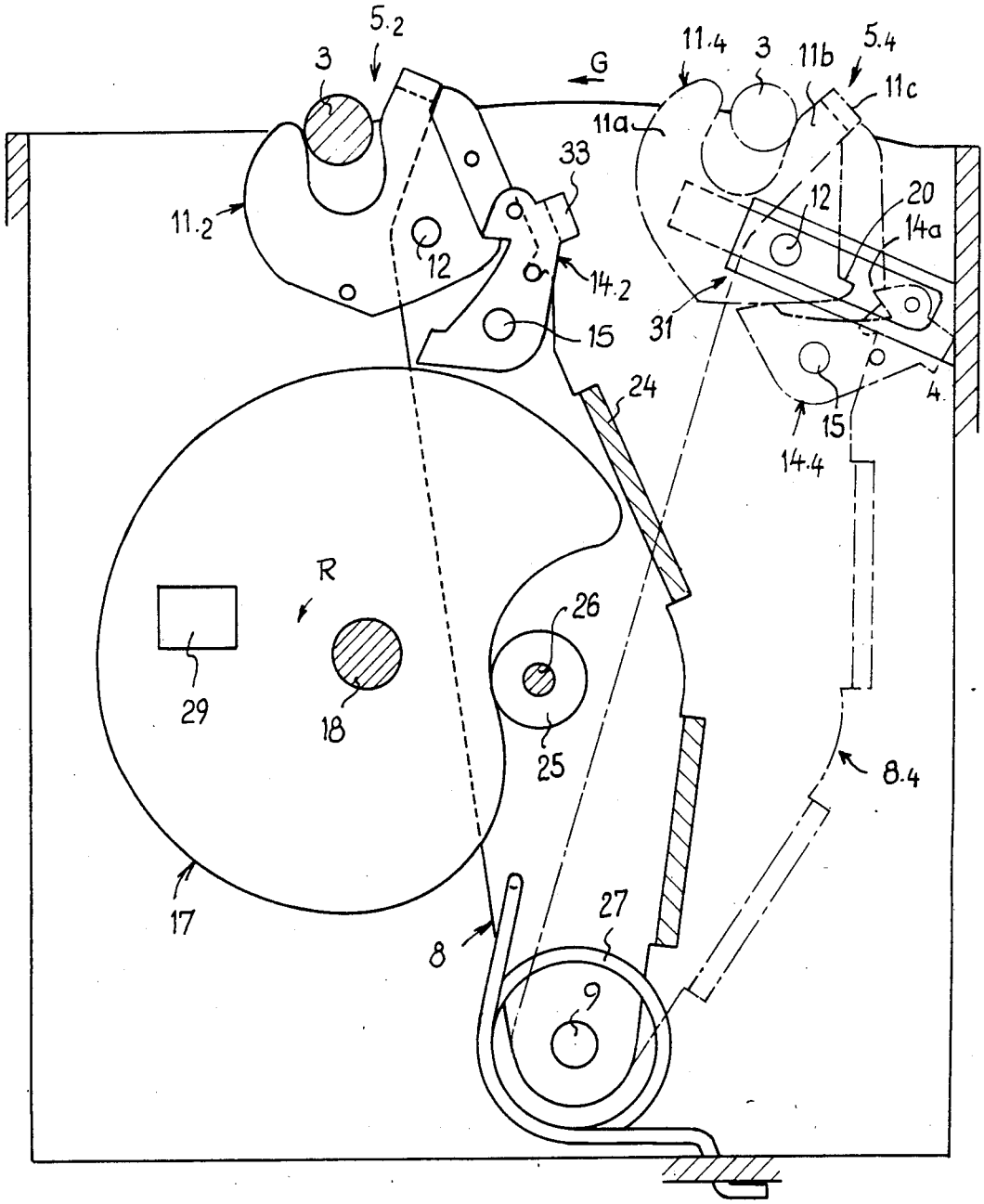
FIG. 4 is a view similar to FIG. 2 of two other possible positions of the various component parts of the mechanism during a closing cycle of the door equipped with the mechanism.

The mechanism 5 will now be described with reference to FIGS. 2 to 8. This mechanism comprises:

a lever 8 pivotally mounted on a fixed pin 9 extending through one of the ends of the lever, i.e. its lower end in the presently-described embodiment;

a fork member 11 rotatably mounted on a pin 12 fixed to the opposite end of the lever 8, and consequently the upper end in the presently-described embodiment, and which is adapted to receive the keeper 3, this fork member 11 being provided with an elastically yieldable element formed by a spring 13 which constantly biases it to its position of disengagement from the keeper 3;

a means for locking the fork member 11 to the keeper 3 during the pivoting of the lever 8 at the start of the closing travel of the door 1, this means being in the presently-described embodiment a pawl 14 pivotally mounted on a pin 15 parallel to the pin 12 and to the pin 9 and in the vicinity of the pivot pin 12 of the fork member; the pawl 14 is provided with a spring 16 which biases it to either of two stable positions in one of which the fork member 11 is unlocked from the pawl 14, while it is locked or awaits the locking in the second stable position;

and a cam 17 rotatively mounted on a fixed pin 18 parallel to the pins 9, 12 and 15, this cam being rotatable by an electric motor 10 (seen in FIGS. 6 to 8), in the counter-clockwise direction indicated by the arrow R in FIGS. 2 and 4.

The fork member 11 defines a hook having two branches 11*a*, 11*b* separated by an opening 19 which receives the keeper 3. The branch 11*b* is provided with a transverse tab 11*c* adapted to slide on a guide ramp 21 provided on the upper edge of a vertical side wall 22 of two vertical side walls 22, 23 which are parallel to each other and between which the lever 8, the cam 17, the fork member 11 and the pawl 14 are disposed. The two side walls 22, 23 support the pivot pins 9 and 18 of the lever 8 and the cam 17 respectively. The pins 12 and 15 are supported at their ends by two parallel plates 8*a*, 8*b* which are pivotally mounted on the pin 9 and interconnected by transverse members only one, 24, of which is seen in the drawings.

The curve of the guide ramp 21 has a convex curved contour and is so determined as to permit the disengagement of the keeper 3 in the event of a break down in the course of operation, irrespective of the position of the lever 8, while limiting the pivoting of the fork member 11 so as to avoid risk of interference with the cam 17. This curve is substantially an arc of a circle whose center is located outside the mechanism. The lever 8 is provided with a rolling roller 25 carried by a journal 26 located between the pins 9 and 15 and supported at its ends by the plates 8*a*, 8*b*. An elastically yieldable element, formed by a coil spring 27 coaxial with the pin 9 and having one end 27*a* anchored in the end wall 28 interconnecting the side walls 22, 23 while its other end 27*b* is anchored in the plate 8*a*, constantly biases the lever 8 to cause it to rotate in the direction which maintains its roller 25 against the profile of the cam 17 (position shown in full lines in FIG. 2).

The profile of the cam 17, which is so arranged that the cam does work constant degree, comprises four consecutive portions extending as follows in the direction opposed to its rotation of rotation 5 (FIG. 2): a first portion AB, subtending an angle at the center of 90°, whose radius evenly increases from A to B, a second portion BC which subtends an angle at the center of between about 90° and 250°, whose radius of curvature only increases slightly from B to C, a portion subtending an angle of between 245° and 320° at the center, and an end region DA subtending from 320° to 360° at the center. The point C corresponds to the normal closed position of the door while the point D corresponds to an additional travel or "excess" travel beyond the closing point C. The first three angular sectors are working regions: rapid advance with a small force (AB), a progressive increase in the force (BC), maximum force (CD), the fourth sector DA constituting the drop of the cam.

The cam 17 is provided with an opening 29 adapted to receive the head of the retractable stop 6 when the cam 17 is in the angular position in which its opening 29 is in facing relation to the stop 6. The projecting part of the latter is rounded as already mentioned so as to permit either its retraction within the center post 2 when the cam is placed in front of the post 2, or its insertion in the opening 29 when the cam 17 is in the suitable angular position with respect to the stop 6.

The fork member 11 is provided with a locking step 20 so as to be locked by a corresponding nose portion 14*a* on the pawl 14.

Figure 5:
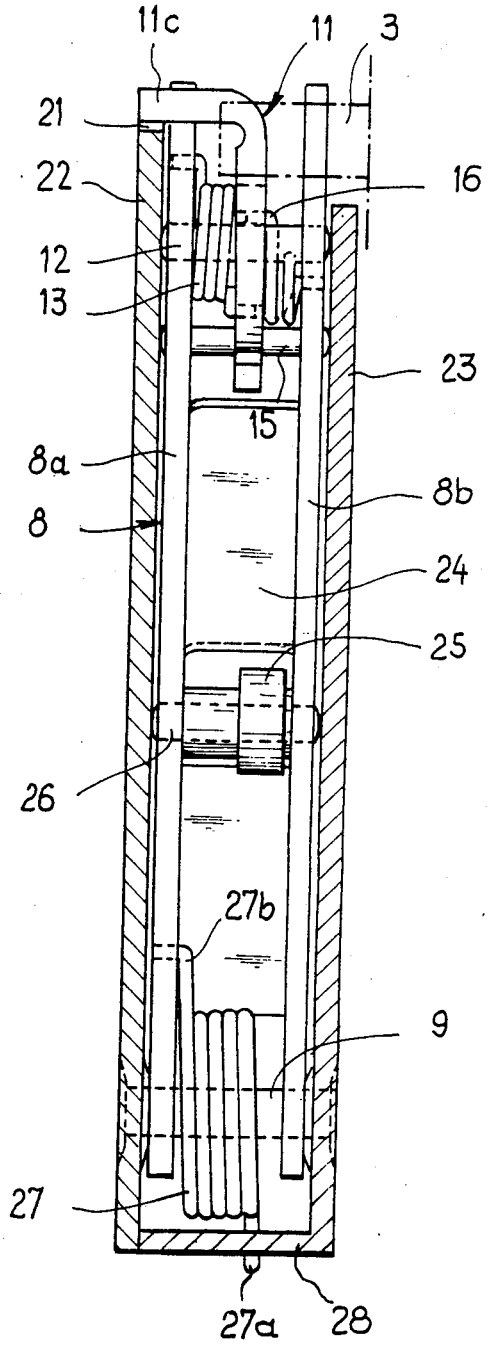
FIG. 5 is an side-elevational view of the mechanism in the direction of arrow K of FIG. 2, the cam not being shown.

The return spring 13 of the fork member 11 is anchored at one of its ends in the upper part of the plate 8*a* and at its other end in the fork member 11, as can be seen clearly in FIG. 5. The return spring 16 of the pawl 14 is anchored at one of its ends in the latter and at its other end in the plate 8*b*.

The mechanism is also provided, in accordance with a feature of the invention, with a stop 31 fixed, in the presently-described embodiment, to the side wall 22 and formed by an elastically yieldable strip provided with an end tab 32 which projects internally between the side walls 22 and 23 (FIGS. 2 and 3) in their upper parts and substantially in alignment with the pawl 14 at the end of the closure of the door 1. The end tab 32 is adapted to be elastically retracted under the thrust of a transverse strip 33 of the pawl 14 when the latter pivots during the closing travel of the door 1 (position shown in dot-dash lines in FIG. 3) and to constitute an anti-return stop for the pawl 14 when the strip 33 has passed beyond said projecting part 32 (position 33*a* in FIG. 3).

Figure 6:
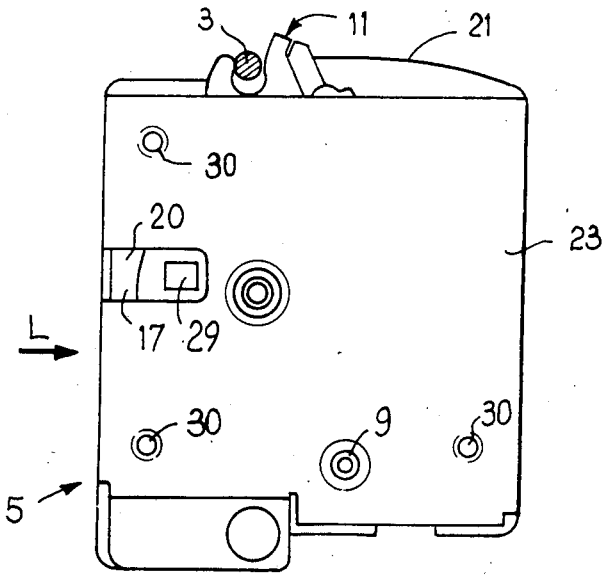
FIG. 6 is an outside elevational view of the whole of the mechanism shown in FIGS. 2 to 5.
Figure 7:
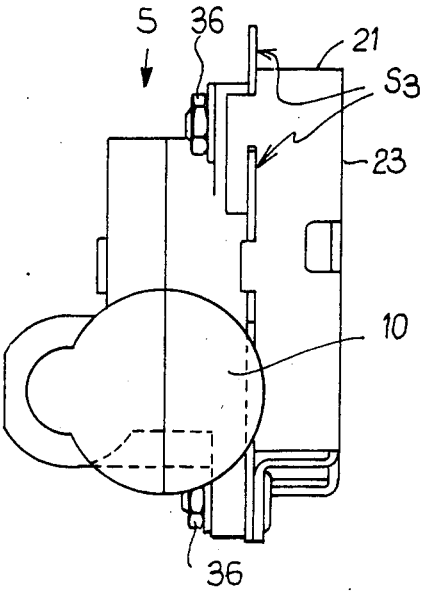
FIG. 7 is a side elevational view in the direction of arrow L of FIG. 6 of this mechanism.
Figure 8:
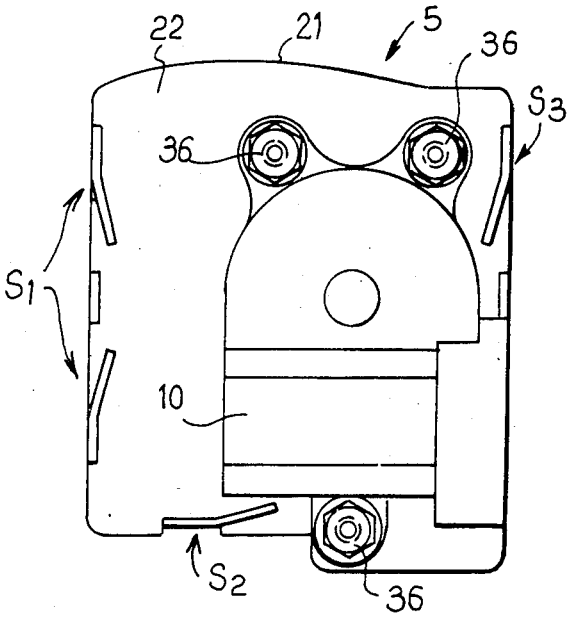
FIG. 8 is a rear elevational view of the mechanism shown in FIG. 6 and 7, from the interior side of the door.

On the outside of the door 1, the mechanism 5 is closed by a transverse wall 34 and on the inside of the door a transverse wall 35, these two walls 34, 35 interconnecting the side walls 22, 23 so as to form with the end wall 28 a case open at its upper end (FIG. 6). The connection of the side wall 22 to the case is ensured by setting lugs $S_1$, $S_2$, $S_3$ (FIG. 8), three openings 30 being provided for the fixing to the door 1. The outer side wall 23 is provided with an opening 20 through which can be seen the cam 17 and its cavity 29 (FIG. 6), and the motor 10 driving the cam 17 is fixed to the rear side wall 22 by bolts and nuts 36 (FIGS. 7 and 8).

The assembly of the assisting mechanism 5 is so dimensioned as to be capable of being mounted within the door 1 while being flush with the outer edge of the latter by the side wall 23, the opening 20 of the latter being open on the inside of the vehicle so that the head of the stop 6 can engage therein and in the cavity 29.

The cycle of operation of the mechanism just described is the following:

With the door 1 of the vehicle assumed to be completely open, the user pulls on the door so as to close it (arrow F in FIG. 1). At about 40 mm from the fully-closed position, the mechanism 5 takes over the control of the door 1 and completes the closure thereof in the following manner.

At the beginning of its operation cycle, this mechanism is in the position illustrated in full lines in FIG. 2 and carries the reference character 5.1: the roller 25 is maintained applied against the profile of the cam 17, substantially in the region of the point A, by the return spring 27 of the lever 8, the cam 17 not being actuated by the motor-speed reducer unit 10; the member 11 is in its position of disengagement from the keeper 3, its hook 11*a* being in the lower position while its branch 11*b* comes into contact with the keeper 3, the transverse tab 11*c* bearing against the start of the guiding ramp 21, the spring 13 maintaining the fork member 11 in this position. The pawl 14 has its nose portion 14*a* unlocked with respect to the corresponding step 20 of the fork member 11 and is maintained in this first stable position by its return spring 16.

The keeper 3 bears against the rear finger member of the fork member 11 constituted by its branch 11*b*, and pivots it and the whole of the fork member 11 to its position carrying the reference character 11.2 in FIG. 4, while the lever 8 is retained in its angular position by its return spring 27. Consequently, the locking step 20, arranged on the fork member 11 on the other side of its pivot pin 12 with respect to the finger member 11*b*, moves downwardly, passes below the nose portion 14*a* of the pawl 14 so that this nose portion is applied against the step 20 and blocks the fork member in the position 11.2, the position of the pawl 14 carrying the reference character 14.2 (FIG. 4). The spring 16 maintains the pawl 14 in this position for locking the fork member 11.2.

This locking of the fork member 11.2 by the pawl 14.2 causes the motor-speed reducer unit 10 to be supplied with current and this unit rotates the cam 17 which starts to rotate in the counter-clockwise direction R. Consequently, the sector AB of the profile of the cam 17 pivots the lever 8 to the right (FIG. 2) through the rolling roller 25, so that this pivoting, which continues while the profile of the cam 17 urges back the roller 25 until the point D comes into contact with the latter, pulls on the door 1 until a position located slightly beyond its fully-closed position is reached by consequently "over-closing" the door. The position of the lever 8, of the fork member 11 and of the pawl 14 at the end of this excess travel is illustrated in dot-dash lines in FIG. 2 and carries the reference character 5.3 (for all of the moving component parts), 11.3, 8.3 and 14.3, the keeper 3 being for reasons of convenience also shown in this position engaged in the opening 19 of the fork member 11.3. The normal closure of the door 1 corresponds to the passage of the point C of the cam 17 across the roller 25, while the "over-closing" travel beyond this normal closure position corresponds to the travel of the sector CD against the roller 25.

Figure 3:
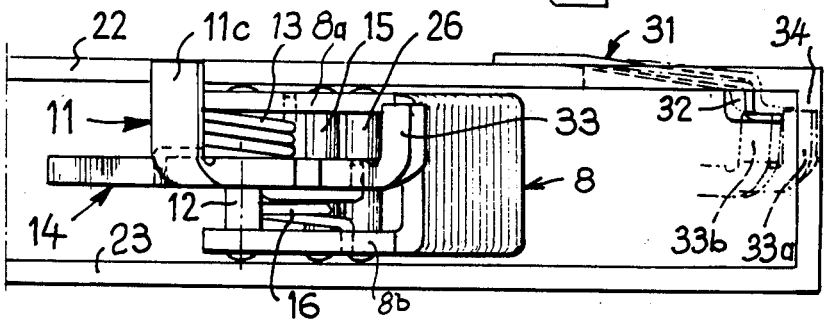
FIG. 3 ia a partial plan view of the mechanism of FIG. 2.

When the point C arrives on the roller 25, the transverse tab 33 of the pawl 14 is in the position 33*b* in FIG.3, in which it slides on the projecting part 32 of the retractable stop 31 which it elastically urges outwardly. The strip 33 continues to slide on the tab 32 during the travel of the sector CD on the roller 25, and passes beyond the end of the tab 32 behind which it therefore assumes a position 33*a* (FIG. 3) while the tab 32 elastically returns to its position shown in full lines in FIG. 3 where it constitutes a stop opposing the rearward return of the strip 33*a* and of the pawl 14.3, whose nose portion 14*a* is still applied against the step 20 of the fork member 11 which is thus maintained in a locked position.

The cam 17 continues its rotation until the return to its position shown in full lines in FIG. 2, in which the cavity 29 is placed in front of the stop 6, which is automatically inserted therein under the action of its return spring 7, the cam 17 being then locked in this angular position.

During the last part of the travel of the cam 17, the lever 8 is biased in the opposite direction by its spring 27 and returns to the extent of the "over-closing" travel plus the clearance between the keeper 3 and its cavity 19 in the fork member 11 so as to occupy its final position 8.4 illustrated in FIG. 4 in the same way as the fork member 11.4 and the pawl 14.4 (the position of all the moving component parts carries the reference character 5.4). This rearward return movement of the lever 8 causes the unlocking of the fork member 11 by the pawl 14 whose nose portion 14*a* is indeed in abutment against the tab 32 of the retractable stop 31. The rearward travel of the lever 8 therefore causes the pawl 14 to pivot downwardly about its pivot pin 15 so as to disengage this nose portion 14*a* from the step 20 of the fork member 11 as shown in FIG. 4. It will be understood that, during this time, the keeper 3 remains in the fork member 11 and prevents the lever 8 from returning to its initial position under the action of its return spring 27. The whole of the mechanism is then in its final position corresponding to the normal closure of the door 1, the motor-speed reducer unit 10 supplied with current by a timing device being stopped at the end of a lapse of time sufficient to close the door.

If the user now wishes to open the door 1, the keeper 3 is shifted by the pivoting of the door in the direction of arrow G shown in FIG. 4. The fork member 11 and the lever 8 accompany this angular shifting of the keeper 3 toward the cam 17 until the roller 25 again comes into contact with the cam. The fork member 11 can then pivot about its pivot axis 12 under the action of its spring 13 so as to return to the position thereof shown in full lines in FIG. 2, in which the keeper 3 is disengaged from the fork member. Correspondingly, the pawl pivots from its position 14.4 to its initial position 14 in which it does not lock the fork member 11. The door 1 moves away from the keeper 3 and the mechanism 5 is ready for a new closure in accordance with the previously-described cycle.

In the event of a break-down of the motor 10 during a cycle, it is sufficient to terminate manually the closure with an excess travel so as to unlock the pawl 14 and use the door in the conventional manner.

FIG. 9 represents a diagram showing a numerical example of the developed forces (Newton plotted as ordinates) as a function of the length of the travel of the door (in millimeters plotted as abscissae), this diagram corresponding to the previously-mentioned numerical values for the profile of the cam 17. However, the three rectilinear segments AB, BC, CD shown in FIG. 9 correspond to the prescribed maximum force values for the mechanism: this signifies that if the closing of the door encounters an accidental resistance exceeding the maximum prescribed value in accordance with the successive sections AB, . . . , the closing of the door is automatically stopped for safety reasons. Below this maximum curve AD, there has been represented a real curve A'B'C'D' of a closing cycle, the dotted line corresponding to the mean forces developed from one end to the other of this real curve. In the event of an unexpected resistance during the first part A'-B' of the closing travel resulting in a peak P' which exceeds the prescribed maximum value of 60 N (for example if a person has left his finger between the door and the center post 2), the mechanism stops automatically. This is made possible by the fact that, in this first part of the cycle, the maximum force developed is low, i.e., in the presently-described embodiment, lower than 6 daN, which avoids providing the door with an additional safety system.

Beyond the point B, i.e. beyond 30 mm of travel, the closing force rapidly increases (section BC) up to a high value (75 daN) of a step CD which corresponds to the "over travel". But during this end of travel BD, it is no longer possible to introduce a foreign body between the door 1 and the center post 2, or between the foreign body and the opposite edge of the door, so that there is no risk of an accident.

The profile of the cam 17 is so designed that the latter does work per degree of rotation which is constant in the course of the cycle, and therefore permits the use of a motor 10 of minimum power.

A numerical example of the determination of the profile of the cam 17 will be given hereinafter so that this cam does constant work per degree of rotation.

The cam 17 must reproduce the force-travel diagram of FIG. 9 for a rotation of 300°. The work to be done is represented by the area between the axis Ox of the abscissae and the maximum curve ABCD. Calculations of the determination of the profile of the cam 17 corresponding to this embodiment are provided hereinafter, the successive angles $\theta_1$, $\theta_2$ and $\theta_3$ corresponding to the successive angular sectors AB, BC, CD.

$$W = \int_{o}^{40} F\,dx$$

$$= (60 \times 30.10^{-3}) + (60 \times 8.10^{-3} + \tfrac{1}{2}\,690 \times 8.10^{-3}) + (750 \times 2.10^{-3})$$

$$= 6.54\ J \frac{\Delta W}{\Delta \theta} = \text{const.} = K = \frac{6.54}{300} = 0.00218\ J/\text{deg}$$

-continued

First stage:

$$0 \leqq x \leqq 30\ \theta \frac{F}{K}\ x = \frac{60}{0.0218}\ x$$

$$x = 30.10^{-3}\ m \rightarrow \theta_1 = 83°$$

Second stage:

$$30 \leqq x \leqq 38\ (\theta - \theta_1) = \int_{30}^{38} \frac{Fdx}{K} = \frac{(43125 \times 60)\ x}{0.0218}$$

$$X = (x - 30 = 10^{-3})\ x = 38.10^{-3}\ m \rightarrow \theta_2 = 148°$$

Third stage:

$$38 \leqq x \leqq 40\ (\theta - \theta_1 - \theta_2) = \frac{Fx}{K} = \frac{750\ X}{0.0218}$$

$$X = (x - 38.10^{-3})\ x = 40.10^{-3}\ m \rightarrow \theta_3 = 69°$$

The invention is not intended to be limited to the described embodiment and may include variations of construction. Thus it is clear that the profile of the aforementioned cam has only been given by way of example and may be modified in accordance with the desired mechanical characteristics for the mechanism. Further, the pawl 14, the lever 8 and the fork member 11 may be made in a way different from that described if equivalent results are obtained.

What is claimed is:

1. A mechanism for assisting the closing of a door of a motor vehicle which is adapted to be disposed within said door, said mechanism comprising:

wall means, a lever pivotally mounted on a fixed pivot pin located adjacent a first end of the lever and mounted on said wall means, a fork member rotatively mounted on a pivot pin fixed to said lever adjacent to an end opposed to said first end of the lever, said fork member being adapted to receive a keeper fixed to a post which is part of a body of said vehicle, a first elastically yieldable element cooperative with said fork member for returning said fork member to a position in which it is disengaged from said keeper, means for locking said fork member to said keeper during the pivoting of said lever and adapted to be effective before the pivoting of said lever, and a cam rotatively mounted on a fixed pivot pin parallel to said fixed pivot pin of said lever and said pivot pin of said fork member, a motor drivingly connected to said cam, means cooperative with said motor for automatically starting up said motor upon said locking of said fork member at the beginning of the closing travel of the door, said cam having such profile as to be cooperative with said lever and pivot said lever against an opposing action of a second elastically yieldable return element for biasing said lever against said cam.

2. A mechanism according to claim 1, wherein the fork member pivotally mounted on said lever comprises a finger member carrying a transversely extending tab, said wall means comprising two substantially vertical side walls which are substantially parallel to each other and between which side walls are located said lever, said cam, and said fork member and which support said pivot pins of said lever and said cam, a curvilinear guide ramp extending through an arc of a circle corresponding to a closing travel of said lever and provided on an upper edge of one of said vertical side walls, said tab being slidable along and guidable by said ramp.

3. A mechanism according to claim 1, wherein said means for locking said fork member to said keeper comprises a pawl pivotally mounted on a pin which is parallel to said pivot pin on which said fork member is pivotally mounted and is in the vicinity of said pivot pin, and a spring cooperative with said pawl for biasing said pawl to either of two stable positions in one of which positions said fork member is unlocked with respect to said pawl.

4. A mechanism according to claim 1, comprising a roller rotatively mounted on said lever, said profile of said cam being cooperative with said roller and so adapted and arranged that said driving motor does constant work per degree of rotation.

5. A mechanism according to claim 4, wherein said motor causes said cam to exert on said lever a low force from 0° to 90° of rotation of said cam during the major part of the door closing travel, a high force from 90° to 250° of rotation of said cam for developing the force required for the end of the closing of the door and an end "over-travel" beyond an effective point of closure of the door, said rotation being followed by a rearward movement of said lever of a few degrees from said "over travel" position to its final position given by a latching of the door, said profile having an end portion which is such that said profile moves away from said roller.

6. A mechanism according to claim 5, comprising a transversely extending strip on said pawl and a stop fixed to one of said side walls and inwardly projecting between said side walls in an upper part thereof substantially in alignment with a position of said pawl at the end of the closing of said door and adapted to be elastically urged back to a retracted position under the effect of a thrust of said transverse strip of said pawl when said pawl is pivoted, then to constitute an anti-return stop for said pawl when said strip has moved beyond said stop, said anti-return stop causing the pivoting of said pawl upon the rearward return of said lever from its "over-travel" position, so that said pawl then escapes from said stop, unlocks said fork member and reaches its second stable position under the effect of the return spring therefor.

7. A mechanism according to claim 1, wherein the cam defines a cavity and further comprising a retractable stop which is adapted to enter said cavity, is movably mounted in said post corresponding to said door and is elastically biased outwardly to a position in which it projects from said post and has such profile as to first of all retract into said post at the beginning of the closing of the door under the effect of the thrust of said cam and then to elastically enter said cavity of said cam when said cam reaches an angular position corresponding to the closure of the door.

8. A mechanism according to claim 7, comprising a transversely extending strip on said pawl and a stop fixed to one of said side walls and inwardly projecting between said side walls in an upper part thereof substantially in alignment with a position of said pawl at the end of the closing of said door and adapted to be elastically urged back to a retracted position under the effect of a thrust of said transverse strip of said pawl when said pawl is pivoted, then to constitute an anti-return stop for said pawl when said strip has moved beyond said stop, said anti-return stop causing the pivoting of said pawl upon the rearward return of said lever from its "over-travel" position, so that said pawl then escapes from said stop, unlocks said fork member and reaches its second stable position under the effect of the return spring therefor.

* * * * *